United States Patent [19]

Collins, Jr. et al.

[11] Patent Number: 4,860,669

[45] Date of Patent: Aug. 29, 1989

[54] ENERGY EFFICIENT CONTINUOUS FLOW ASH LOCKHOPER

[75] Inventors: Earl R. Collins, Jr., La Canada; Jerry W. Suitor, El Toro, both of Calif.; David Dubis, Morgantown, W. Va.

[73] Assignee: The United States of America as represented by the Administrator of the National Aeronautics and Space Administration, Washington, D.C.

[21] Appl. No.: 195,222

[22] Filed: May 18, 1988

[51] Int. Cl.[4] ..... F23J 1/00

[52] U.S. Cl. ..... 110/165 R; 110/171; 110/259; 414/217; 414/220

[58] Field of Search ..... 110/165 R, 171, 259; 414/217, 220; 138/42

[56] References Cited

U.S. PATENT DOCUMENTS

| | | | |
|---|---|---|---|
| 2,420,217 | 5/1947 | Allen | 302/17 |
| 2,590,202 | 3/1952 | Norton | 414/217 |
| 2,713,949 | 7/1955 | Stevenson | 414/217 |
| 2,834,665 | 5/1958 | Rudolph et al. | 48/87 |
| 3,578,009 | 5/1971 | Spyropoulos | 137/81.5 |
| 3,935,825 | 2/1976 | Matthews et al. | 110/165 R |
| 4,023,280 | 5/1977 | Schora et al. | 110/165 X |
| 4,131,134 | 12/1978 | Lindberg | 137/808 |
| 4,388,950 | 6/1983 | Stouffer et al. | 137/829 |
| 4,397,731 | 8/1983 | Warzel | 208/8 LE |
| 4,418,722 | 12/1983 | Kendall et al. | 138/42 |
| 4,422,476 | 12/1983 | Blanchard | 137/810 |
| 4,459,071 | 7/1984 | Norton et al. | 406/108 |
| 4,790,251 | 12/1988 | Vidt | 110/165 R |

*Primary Examiner*—Edward G. Favors

*Attorney, Agent, or Firm*—Thomas H. Jones; John R. Manning; Charles E. B. Glenn

[57] ABSTRACT

A continuous flow ash lockhopper includes an ash hopper at the outlet of a high temperature, high pressure reactor vessel containing heated high pressure gas, a fluidics control chamber having an input port connected to the ash hopper's output port and an output port connected to the input port of a pressure letdown means, and a control chamber connected to a variable pressure control fluid (gas or steam) supply for regulating the pressure in the control chamber to be equal to or greater than the internal gas pressure of the reactor vessel, whereby the reactor gas is contained while ash is permitted to continuously flow from the ash hopper's output port, impelled by gravity. The fluidics control chamber may be provided with a variable port to inject control fluid at a desired velocity. The control fluid impinges the flow of ash into the chamber at a right angle to create a vortex in the chamber with the vortex path being from the input port around the output port and then crossing generally over the output port offset from the input port.

20 Claims, 3 Drawing Sheets

ENERGY EFFICIENT CONTINUOUS FLOW ASH LOCKHOPER

ORIGIN OF THE INVENTION

The invention described herein was made in the performance of work under a NASA contract, and is subject to the provisions of Public Law 96-517 (35 USC 202) in which the Contractor has elected not to retain title.

TECHNICAL FIELD

The invention relates to a continuous flow lockhopper, and more particularly to a lockhopper which allows continuous withdrawal of a solid product, such as ash, from a pressurized high temperature reactor vessel while limiting loss of hot reactor gases with the product.

BACKGROUND ART

Conventional reactor lockhoppers operate in a batch mode, causing significant loss of energy, both in pressurization and depressurization at each batch dumping, and concomitant heat loss from the system. In addition, the airlock valves, which close off the lockhopper, operate in an extremely hostile environment—hot and abrasive—which severely limits the life of the pressure seals and valves.

During each batch dump, a substantial amount of reactor vessel gases are released to the outside air. These are often hazardous toxic gases which must be scrubbed, or otherwise purified, before final release. Even when the reactor gases are harmless, they carry away a substantial amount of heat energy which must be replaced when the reactor vessel is fired up again for the next batch.

Two additional problems have been addressed by this invention: the continuous, though much reduced, loss of reactor vessel gas, and the fact that it is not always desirable to permit steam to enter the reactor. The leakage of reactor gas causes a loss of heat energy, and gas volume which must be replaced, or in those cases where the gas is the process product, a reduction in yield. It would be highly desirable to reduce further these extra operating costs, or eliminate entirely the loss of hot gases from the reactor.

STATEMENT OF THE INVENTION

In addressing these problems in an ash lockhopper, fluidics control is employed to throttle down the flow of ash and reactor gas from the ash hopper outlet of the reactor vessel, prior to passing the flow through a pressure letdown device. The fluidics control is achieved by supplying its control port with steam generated by cooling water injected into a cooling water jacket around the reactor's ash hopper. This fluidics control represents a substantial improvement in the art to achieve continuous ash flow, along with successful flow control, pressure letdown, and an energy-efficiency greatly improved over conventional batch processes. A cyclonic separator (not shown) on the output of the system separates effluent steam and gases from the solid product.

The loss of hot gases from a pressurized high temperature reactor vessel in a continuous flow lockhopper is due to continuously dropping the process product, or in those cases where the gas is the process product, the solid by-product, both of which (the solid product and the solid by-product) are referred to hereinafter as the solid reactor product, using gravity as the moving force through a hopper. This loss is minimized by the aforesaid fluidics control using a control chamber where an equalizing pressure of fluid (air, steam or inert gas) is maintained to prevent all but a very little of the gas in the reactor chamber from passing through the control chamber with the solid reactor product. This is accomplished by introducing a pressurized control fluid through a control valve into the control chamber, and controlling the valve by means for approximately equalizing pressure of reactant gases in the reactor vessel with back pressure from the control chamber to the valve. As a result, virtually none of the reactant gases will flow through the hopper into the control chamber. The pressure of the control fluid into the control chamber is preferably controlled to be slightly greater than the pressure of gases in the reactor in order to create a spiral motion of the solid reactor product in the control chamber. That helps move the product through the control chamber into a pressure letdown means. The solid reactor product thus passes continuously through the control chamber and the pressure letdown device, where the pressure of the solid reactor product is reduced to atmospheric pressure with only a small amount of control gas outflow.

The novel features that are considered characteristic of this invention are set forth with particularity in the appended claims. The invention will best be understood from the following description when read in connection with the accompanying drawings.

DETAILED DESCRIPTION OF THE INVENTION

Figure 1:
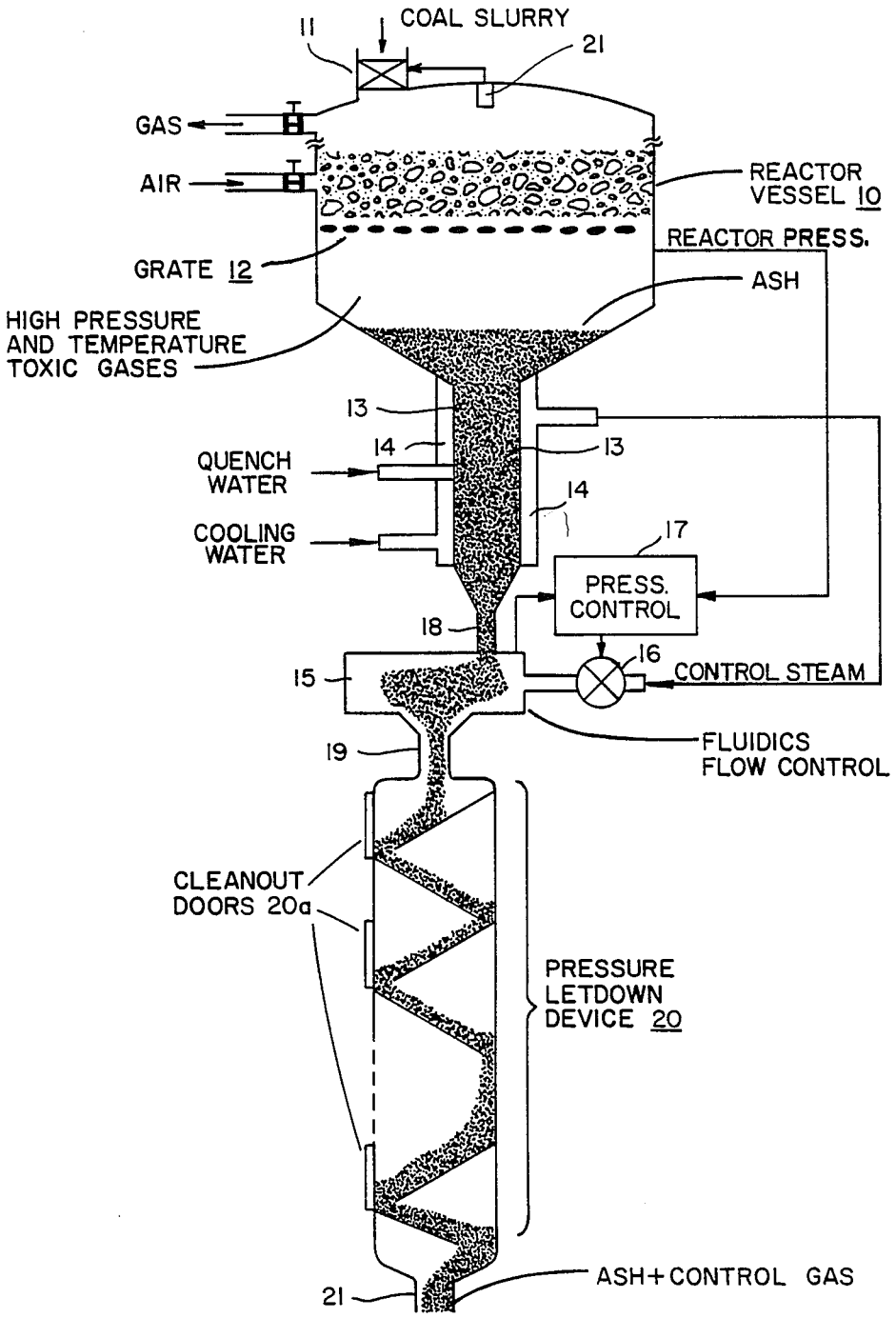
FIG. 1 illustrates schematically the fluidics control employed in a lockhopper to prevent outflow of reactor gases with solid reactor product continuously removed from a reactor vessel by gravity.

Referring to FIG. 1 of the drawings, a continuous flow ash lockhopper is disclosed by way of example of the present invention and not by way of limitation, since the fluidics control disclosed may be used in any type of reactor where the loss of reactor gases is to be eliminated, and a solid product, or by-product, is continuously drawn out.

The ash lockhopper shown allows ash to be continuously removed from a reactor vessel 10 in which a material (coal slurry) is continuously fed through an airlock valve 11 from an inlet lockhopper (not shown). The coal reacts with air to turn into ash. A grate 12 is shown symbolically under the fluidized bed of coal; it can be any one of the many conventional mechanical grates available for breaking up clinkers and large cinders. The fine ash falls down through the grate leaving high pressure and temperature toxic gases above the ash. For example, burning coal to produce heat results in ash and toxic gases. Whereas the ash may be a desirable byproduct to be carried away, the gas should not be because of its heat that may be utilized productively.

In this system, the ash is permitted to flow gradually down out of the reactor vessel past a normally open backup valve (not shown), which is closed only during maintenance and emergencies. The ash, cinders and clinkers in an ash lockhopper 13, which are still very hot, may be exposed to a stream of quench water, which explosively destroys the cinders and clinkers, and reduces them to the size of ash granules. The water flashes to steam on contact with the hot ash. In the past, this quenching has taken place in, or after, the ash lockhopper 13, and the steam has been vented to the outside air, not into the reactor vessel. In this invention, the steam may enter the reactor vessel and mix with the toxic gases. As the toxic gases are cooled, the steam condenses and can easily be removed, along with the water of combustion, by a cyclone separator (not shown) at the system output.

A water jacket 14 surrounds the quench chamber; some of the heat in the ash lockhopper 13 may be used to generate steam which may then be used as a control gas for operating a fluidics flow control chamber 15 at the lower end of the lockhopper 13. The flow control chamber is a vortex-type flow control chamber, which will be described with reference to FIGS. 2*a, b* and *c*. Its functions are to throttle down the flow of ash and steam from the ash lockhopper 13 to a slow enough flow that full ash size reduction can take place, and most importantly, to maintain the high pressure of the reactor vessel, i.e., to eliminate loss of reactor gases. An emergency and maintenance shutoff valve (not shown) may be inserted between the ash lockhopper 13 and the flow control chamber 15; it is normally open during continuous flow operation.

The falling cinders, clinkers and fine ash settling in the bottom of the reactor vessel 10 fall down through the ash lockhopper 13. From there the reactor byproduct passes into the control chamber 15. This chamber effects flow control of the product by varying the pressure and velocity of a control stream of fluid in line with the product stream flowing from an input port 23 (FIGS. 2*a, b* and *c*) into the control chamber 15. Impinging control fluid creates a vortex (cyclonic flow) of the ash which acts as a throttle on the ash flow through the control chamber 15, as will be described more fully with reference to FIG. 2*a*, 2*b* and 2*c*.

The loss of gases from the reaction vessel (contained between the grate 12 and the bottom of the reactor vessel where ash falling through the grate is collected) is eliminated by control of the pressure of the control fluid stream into the control chamber 15. Although steam is indicated as the control fluid, it may be air or inert gas as well, or a combination of these. This control fluid is introduced into the control chamber 15 through a control valve 16 at a pressure equal to or greater than the pressure of toxic gases in the reactor vessel 10. Once the gas pressure in the control chamber is set equal to or greater than the pressure of toxic gases in the reactor vessel, there will be no pressure gradient to cause reactor gas to exit the reactor vessel through the lockhopper 14.

A pressure control means 17 compares the pressure of the reactor gases, and the pressure of the control gas in the control chamber 15, to properly balance them by operation of the control valve 16. Thus, the high equalizing pressure of control gas from a source (shown here as steam from the cooling water jacket) is introduced at a pressure equal to or slightly greater than the reactor pressure. That arrangement allows very little if any of the reactor gases to flow with the ash through the hopper into the control chamber 15, but ash, which is of higher specific density than the control gas, will pass into the control chamber 15 through a throat 18 of a smaller diameter than a throat 19 into a pressure letdown device.

The fine ash and some control gas steam passes through the pressure letdown device 20 to reduce the pressure of the ash and control gas to that of the atmosphere. That device 20 is preferably a modification of the one shown schematically in FIG. 1, namely a modification as disclosed in FIGS. 3*a, b* and 4*a, b*. In these devices a number of stages are used, each stage causing a small pressure drop and allowing a slow flow of the fluid stream (ash and control gas) such that erosion of the device by the abrasive particles carried in the fluid stream is held to a minimum. The pressure of ash, and control gas surrounding the ash, is gradually reduced as the ash cools. As a consequence, ash is recovered at an outlet throat 21 of the pressure letdown device with only a small volume of control gas (steam) outflow. The steam is separated from the fine ash by a cyclone separator (not shown).

While this process of recovering ash is carried out, fresh material (coal slurry) is continuously introduced into the reactor vessel 10 through the airlock valve 11 normally open, but which may be regulated by, for example, a sensor 22 near the top of the reactor vessel to produce a control signal that reduces flow of the material until the level of coal slurry drops and is no longer being sensed. In that manner, the reactor may be continuously fed input material to produce a continuous flow of reactor output material without significant loss of toxic gases from the reactor vessel.

Control of the ash inlet to the chamber 15 through the throat 18 will change flow rate of the ash, which is impelled downwards solely by gravity. Although flow control is also dependent on control fluid (steam) pressure, and changing the control setting will be reflected in a change in the pressure drop across the ash inlet throat 18 such that there will be some interaction, precise ash inlet control and control fluid pressure settings can be accomplished rapidly by the use of automatic control means employing pressure sensing. This will keep reactor gas losses caused by flow adjustments to a minimum. Once a steady state is reached, virtually all of such gas losses will cease.

Figure 2A:
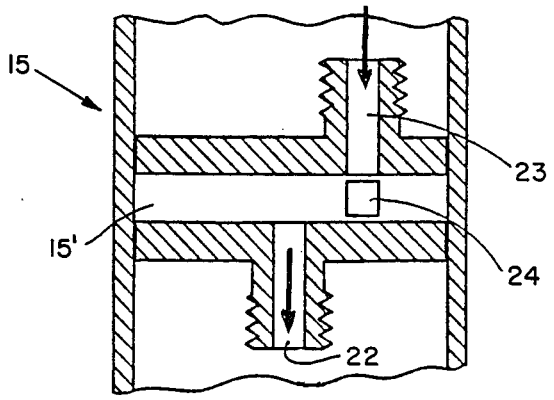
FIGS. 2*a* and 2*b* illustrate schematically sectional side view and sectional plan view, respectively, of a control chamber which may be used to prevent reactor gases from escaping out of a hopper of the reactor vessel into a pressure letdown device, and from there into the atmosphere.
Figure 2B:
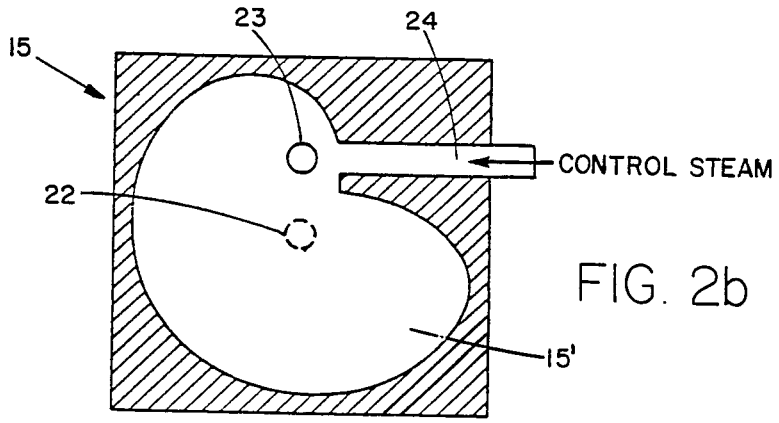

Referring now to FIGS. 2*a* and 2*b*, the outlet port of the control chamber 15 is schematically illustrated at 22 in the geometric center of the control chamber, while the input port 23 is offset from the center and directly in line with a control inlet port 24 for the control fluid (steam). The control fluid enters the internal chamber 15' through the inlet port 24 and impinges on the stream of reactor product entering through the port 23. The result is creation of a vortex which circulates within the chamber 15' along the sidewalls thereof. As the flow of control fluid is increased, the vortex is accelerated, and enlarged in diameter, thus delaying the exit of the product flow through the centrally located output port 22.

This has the effect of decreasing flow rate and increasing the hydraulic heat loss between the input port 23 and the output port 22.

The control fluid pressure and velocity are controlled by controlling the input pressure of the control fluid and the size of the inlet port 24. The higher the control fluid pressure, the greater the velocity of the control fluid jet impinging upon the reactor product stream coming in through the inlet port 23. Thus, the cross sectional area of the inlet port 24 is an important determinant of the effect of the control fluid flow on the vortex of the product stream. In any one device, this area of port 24 is fixed. If this area does not fit a particular set of stream input/output conditions, the device must be changed to another having a different ratio of supply and output port cross sectional areas. In laboratory conditions, this device exhibits a ratio of as much as five to one. However, in field conditions, it is more usual to obtain ratios of as low as two to one.

Figure 2C:
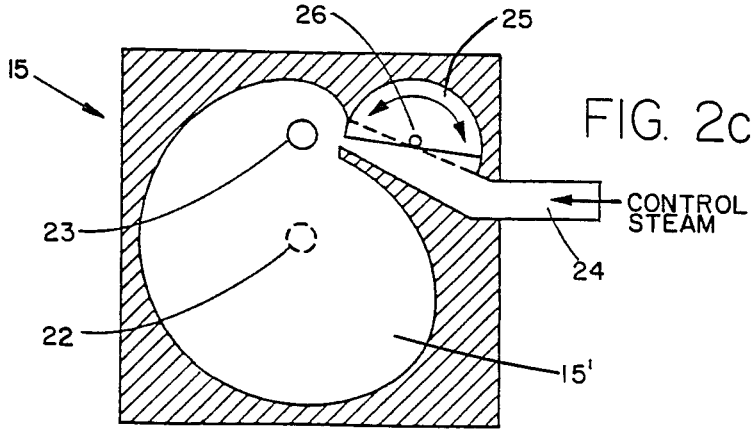
FIG. 2*c* illustrates a variant of the cross sectional plan view for the control chamber of FIG. 2*b*. It provides means for throttling down the flow of solid reactor product.

FIG. 2*c* illustrates a control chamber with means for varying the control ratio comprising a D-shaped sector 25 rotatable about its pivot by a shaft 26 such that it can throttle down the cross sectional area of the control port 24, open it to a maximum, or set it to any intermediate setting. This also affects volume and port heat loss, but if control gas supply pressure can be varied, independent control of control gas volume and velocity is possible. This enables adjustment to a wider range of control conditions, and the ability to maximize control efficiency. Fluidics control theory indicates an improvement in control ratio of at least two to one over conventional control devices.

The pressure letdown device 20 in the fluid stream after the control chamber 15 may be a device of the type described in U.S. Pat. No. 4,418,722 filed by James S. Kendall and John V. Walsh and assigned to the National Aeronautics and Space Administration. Pressure letdown devices of this type consist of a series of pressure letdown stages, each stage having horizontal, flat or V-shaped baffles with successively larger openings through the baffles and/or progressively more openings at each stage. Since reactor products expand as pressure is reduced, each baffle of the pressure letdown device should be provided with an integrated area of opening greater than in the preceding baffle. However, it has been found that it is sufficient to use sloping baffles as shown in FIG. 1, with a casing of uniform diameter, and an opening in the successive baffles of sufficient area to accomodate the flow of the solid reactor product through the throat 19, given that the reactor product expands as the pressure is reduced. Thus, to accomodate the progressive expansion of reactor product in the letdown device having sloping baffles, an opening at the bottom of each successive baffle may be made progressively larger.

Figure 3A:
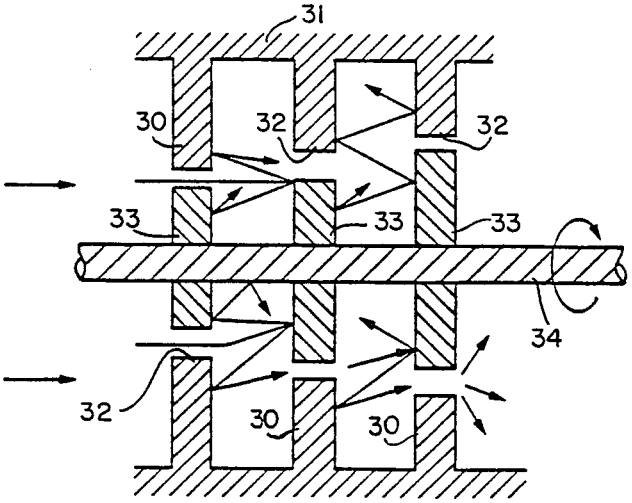
FIGS. 3*a* and 3*b* illustrate a variant of the pressure letdown device of FIG. 1.
Figure 3B:
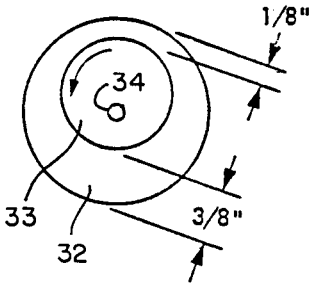

Another variation illustrated schematically in FIGS. 3*a* and 3*b* is to employ parallel baffles 30 in a cylindrical casing 31 of uniform diameter, but instead of apertures in the baffles, which increases in number and/or size from one baffle to the next, there is provided in each baffle an annular opening 32 of successively larger diameter from one baffle to the next, with the center part 33 of each annular opening constituting a disk of successively larger diameter mounted on a shaft 34 rotated on the axis of the cylindrical casing. However, each such circular disk is mounted on the shaft with an offset from its center, as shown in FIG. 3*b*, so that the annular opening has a varying width, and as the disk is rotated the gap varies from, for example, 150" to 154". This is not for the purpose of grinding the solid reactor product particles, but to simply break them apart as they pass from baffle to baffle with an ever increasing annular opening from baffle to baffle to accomodate the expansion of the particles as pressure is reduced.

Figure 4A:
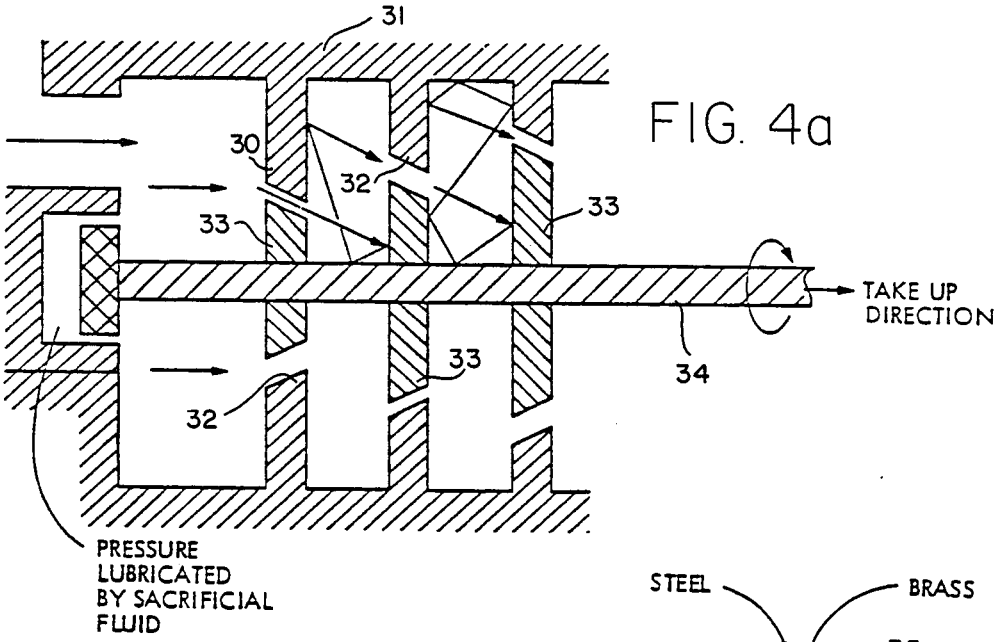
FIGS. 4*a* and 4*b* illustrate another variant of the pressure letdown device of FIG. 1.

The phase of rotation from one disk to another is preferably 180° so that the probability of the particles striking the next disk in succession is increased. To further enhance that by more positively increasing the tortuous path of the particles passing through the pressure letdown system, the annular opening for each baffle having an offset disk (with the offset direction alternated from disk to disk for rotation of adjacent disks 180° out of phase) may have sides sloped to provide a general direction toward the axis for particles passing through each baffle, as shown in FIG. 4*a* where the same reference numerals are shown as in FIG. 3*a* for the same corresponding parts. The "tortuous path" thus assured is consequently increased by vector redirection at each baffle for increased energy redirection. As the walls of the annular openings wear, the total area of the opening may be maintained substantially constant by adjusting the axial position of the shaft. This is made possible by the sloped walls of the annular openings since adjusting the axial position of the shaft moves the disks further into the stationary part of each baffle thus making the annular opening smaller for each baffle.

Figure 4B:
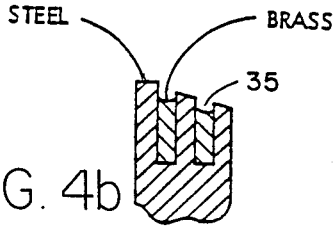

If some grinding of the particles is desirable, a spiral configuration of a groove on the surface of the disk annular opening may be provided as shown in FIG. 4*b*. This grinding action would provide clearing of any adhered particles to avoid clogging. The spiral groove 35 on the edge of the disk can be made deeper than is necessary and partly refilled with a spiral brass insert in the spiral groove 35 of each steel disk. The brass insert, in wearing away faster than the steel disk wears, would provide a constant spiral "bite". The steel of the disk extends further and wears slower, while the brass insert wears faster because it is softer than steel, but, because the brass is recessed, the rate of wear of both would be of the same approximate rate.

The invention realistically provides for the first time an ash lockhopper system that will attain a high degree of energy efficiency, eliminate reactor gas loss so as to obtain the highest possible product yield while permitting a controllable continuous ash flow, and continuous reactor processing.

While this invention is primarily intended to convert a gas producing, reaction coal burning furnace from batch to continuous flow operation, the system has many different application possibilities. For example, fluidized-bed reactor systems, such as those used in the chemical and petrochemical industries, would be benefitted by use of this system. Since the invention essentially operates as a solids/gas separator, it has many applications in the fields of solids separation, dust separation, and the like.

Although particular embodiments of the invention have been described and illustrated herein, it is recognized that modifications and variations may readily occur to those skilled in the art. Consequently, it is intended that the claims be interpreted to cover such modifications and variations.

We claim:

1. A continuous flow lockhopper for the removal of output product, or byproduct, of a reactor comprising a hopper at the bottom outlet of a high temperature, high pressure reactor vessel containing heated high pressure gas for continuous removal of said reactor products or byproducts by gravity force, a fluidics flow control chamber having an input port connected to said hopper of said reactor vessel, said control chamber further having an output port for the passage of nongaseous reactor products and a pressure control inlet port, a continuous flow pressure letdown means connected to said output port of said control chamber for gradually reducing the pressure of said nongaseous reactor products, a source of pressurized control gas connected to said pressure control inlet of said control chamber, and means for controlling the pressure of said control gas into said control chamber to maintain the gas pressure in said control chamber equal to or slightly higher than the gas pressure in said reactor vessel to substantially eliminate or minimize reactor gas losses from said reactor vessel through said hopper during flow control adjustment, and to eliminate such losses during steady state operation of said continuous flow lockhopper.

2. A continuous flow lockhopper as defined in claim 1 wherein said source of pressurized control gas comprises a water jacket surrounding said outlet hopper, said water jacket having a cooling water inlet and a steam outlet, and said means for controlling the pressure of said control gas into said control chamber is comprised of a valve connected to said pressure control input port of said control chamber and a pressure control means responsive to the difference in pressure between said control chamber and in said reactor vessel to maintain the pressure in said control chamber equal to or slightly higher than the pressure in said reactor vessel, thereby to substantially eliminate or minimize losses of gases in said reactor vessel through said control chamber during flow control adjustments and to eliminate such losses during steady state operation while nongaseous reactor products feed from said outlet hopper through said control chamber into said pressure letdown means.

3. A continuous flow lockhopper as defined in claim 2 wherein the axis of said input port of said control chamber is offset from the center of said control chamber output port and said pressure control inlet of said control chamber directs steam perpendicularly to the flow of said nongaseous reactor products flowing into said chamber in a direction at least 90° from a line between the center of said inlet and outlet ports, and said control chamber having a curved shape to create a vortex which starts at said pressure control inlet port, surrounds both said input and output ports of said control chamber, and ends at a point near said pressure control inlet and outlet ports, said curve shape being fashioned to intercept said flow of nongaseous reactor products redirected by said steam entering said control chamber through said pressure control inlet and create a vortex of said redirected nongaseous reactor products from the input port towards said output port after passing around said output port.

4. Apparatus as defined in claim 3 including means for adjusting the size of said steam inlet to said control chamber comprising a D-shaped sector pivotally positioned on one side of said inlet contiguous with said inlet to vary the inlet size from a maximum while the straight part of said D-shaped sector is in line with said one side of said inlet, to a minimum while the straight port of said D-shaped sector is pivoted to very near the side of said inlet opposite said one side at the point where said inlet opens into said control chamber.

5. Apparatus as defined in claim 4 wherein said pressure letdown means for gradually reducing the pressure of said nongaseous reactor products is comprised of a tubular chamber having baffles perpendicular to the axis of said tubular chamber with annular openings of successively larger openings from one baffle to the next starting at the inlet end of said tubular chamber, each center part of said tubular chamber being supported by a shaft having its axis coincident with the axis of said tubular chamber.

6. Apparatus as defined in claim 5 wherein said shaft is rotatable.

7. Apparatus as defined in claim 6 wherein the center of each of said center parts is offset from the axis of said shaft, and the offset is in the opposite direction of the offsets for adjacent center parts.

8. Apparatus as defined in claim 7 wherein said annular openings have side walls sloped in the direction of flow toward the axis of said shaft, and said shaft is adjustable in axial position to adjust the size of said annular openings as the sides of said openings wear.

9. Apparatus as defined in claim 8 wherein the side wall of each center part of said baffles having annular openings is provided with a spiral groove.

10. Apparatus as defined in claim 9 wherein said spiral groove of each center part is partially filled with a spiral form of a metal softer than the metal of center part.

11. Apparatus as defined in claim 1 wherein said pressure letdown means for gradually reducing the pressure of said nongaseous reactor products is comprised of a vertical chamber having horizontal baffles with annular openings of successively larger diameter from one baffle to the next starting at the top of said vertical chamber, each center part of said vertical chamber being supported by a shaft having its axis coincident with the center of said annular openings.

12. Apparatus as defined in claim 11 wherein said shaft is rotatable.

13. Apparatus as defined in claim 12 wherein the center of each of said center parts is offset from the axis of said shaft, and the offset is in the opposite direction for adjacent center parts.

14. Apparatus as defined in claim 13 wherein said annular openings have side walls sloped in the direction of flow toward the axis of said shaft, and said shaft is axially adjustable in position to adjust the size of said annular openings as the sides of said annular openings wear.

15. Apparatus as defined in claim 14 wherein the side wall of each center part of said baffles having annular openings is provided with a spiral groove.

16. Apparatus as defined in claim 15 wherein said spiral groove of each center part is partially filled with a metal softer than the metal of said center part.

17. An energy efficient continuous flow lockhopper comprising a reactor vessel, a lockhopper below said reactor vessel for continuous removal of said reactor products or byproducts by gravity force, a source of control fluid under pressure, a fluidics flow control chamber at the bottom of said lockhopper, means for controlling the pressure of control fluid in said control chamber to regulate fluid pressure at the bottom of said lockhopper to a pressure at least equal to fluid pressure in said reactor vessel, whereby fluid is prevented from exiting the reactor through said lockhopper while solid reactor products or byproducts flow continuously through said control chamber and said lockhopper under the force of gravity.

18. An energy efficient continuous flow lockhopper as defined in claim 17 including a pressure letdown device comprising a vertical chamber connected to said fluidics control chamber to receive solid reactor products or byproducts fed by gravity from said reactor, and horizontal baffles in said chamber with successively larger openings to accomodate the downward flow therein as pressure is reduced gradually with said successively larger openings accommodating the same flow rate of solid reactor products, or by products, which expand upon pressure being reduced, and means for continuously feeding material into said reactor vessel.

19. An energy efficient continuous flow lockhopper as defined in claim 17, including a source of pressure control fluid, wherein said control chamber not only provides a place through which pressure is applied to the bottom of said reactor, but also a place to control a flow rate of solid reactor products, or byproducts, out of the bottom of said reactor, said control chamber having an input port offset from the center of an output port and a control inlet for receiving a pressure control fluid into said chamber, said control inlet being positioned to introduce pressure control fluid directly over said input port in a direction at least 90° away from the direction of said input port to said output port, said control chamber having a curved side wall to create a vortex which starts at said input port, surrounds said output port, and passes generally over said output port, the size of said vortex depending upon the velocity imparted to the flow of said reaction products, or byproducts, by said control fluid, said velocity being a function of pressure and volume of control fluid, such that the greater said velocity, the larger the vortex, and therefore the lower the reactor product, or byproduct flow rate.

20. An energy efficient continuous flow lockhopper as defined in claim 19 including means for controlling the cross sectional area of said pressure control inlet to control the velocity of control fluid injected into said control chamber, thereby controlling the flow rate of the reactor product, or byproduct.

* * * * *